US005911501A

United States Patent [19]

Katz

[11] Patent Number: 5,911,501

[45] Date of Patent: Jun. 15, 1999

[54] HOME DECORATION SYSTEM

[75] Inventor: Harvey Katz, Boca Raton, Fla.

[73] Assignee: Empire Industries, Inc., Delray Beach, Fla.

[21] Appl. No.: 08/780,045

[22] Filed: Dec. 23, 1996

[51] Int. Cl.[6] ..... F21V 17/00

[52] U.S. Cl. ..... 362/267; 362/353; 362/124; 362/806; 362/808

[58] Field of Search ..... 362/121, 124, 362/235, 353, 152, 267, 806, 431, 352, 249, 808, 363, 391, 252

[56] References Cited

U.S. PATENT DOCUMENTS

| | | | |
|---|---|---|---|
| D. 215,304 | 9/1969 | Kadmon et al. . | |
| 1,349,374 | 8/1920 | Gruenfeld, Jr. | 362/124 |
| 1,410,336 | 3/1922 | Ludwig . | |
| 2,714,652 | 8/1955 | Meyer | 362/806 |
| 2,734,993 | 2/1956 | Fritz | 362/124 |
| 2,794,284 | 6/1957 | Burnbaum . | |
| 2,815,439 | 12/1957 | Plubell | 362/806 |
| 3,220,130 | 11/1965 | Falkenberg | 362/808 |
| 4,234,915 | 11/1980 | Malinowski et al. . | |
| 4,591,959 | 5/1986 | Kenyon . | |
| 4,833,580 | 5/1989 | Allen | 362/806 |
| 5,183,329 | 2/1993 | Chen | 362/352 |
| 5,222,802 | 6/1993 | Beck . | |
| 5,274,537 | 12/1993 | Altman . | |
| 5,309,333 | 5/1994 | Kandampully . | |
| 5,359,506 | 10/1994 | Koleno . | |
| 5,436,817 | 7/1995 | Wotton et al. | 362/353 |
| 5,526,243 | 6/1996 | Masters | 362/806 |
| 5,685,635 | 11/1997 | Barthelmess | 362/806 |

*Primary Examiner*—Thomas M. Sember
*Attorney, Agent, or Firm*—Laff, Whitesel & Saret, Ltd.

[57] ABSTRACT

A decorative lighting system uses a plurality of figurines, usually a family of characters appropriate for a specific holiday, such as: jack-o-lantern, ghosts, witches, black cats, skeletons, etc. for halloween or Santa Clause, candles, candy canes, reindeer, etc. for Christmas. The figurines are all plastic, preferably blow molded with a sloping top that provides a weather resistant roof. The figurines may be made to hang from above or to be supported on the ground, or both hanging and supported. Light bulbs of an indoor/outdoor string of Christmas tree lights may be attached to the figurines by an elastomeric coupler. An adapter mounting plate enables the figurines to be substituted for fixtures on posts in a permanent ground lighting system.

9 Claims, 11 Drawing Sheets

HOME DECORATION SYSTEM

FIELD

This invention relates to home decorative systems and more particularly—but not exclusively—to exterior lighting systems, and still more particularly, for seasonal decorative lighting of the front of a house or home.

BACKGROUND

For a background knowledge of decorative lighting devices, reference may be made to the following U.S. Pat. Nos. 1,410,336; 2,714,652; 2,794,284; 4,234,915; 4,591,959; 5,222,802; 5,274,537; 5,309,333; 5,359,506; and U.S. Pat. No. Des. 215,304.

There are many seasons when one would like to decorate a home in an appropriate and individualistic way, as by stringing lights in the front yard, for example. If there are trees in front of the house, one might want to have lighted figurines in the form of seasonal characters which appear to be floating in among the branches. In another example, the house may have a permanent ground lighting system as a safety feature around stairs, a walk way, or the like, which can be used in connection with providing a decorative system according to the present invention.

One might wish to coordinate these and other decorations. For example, one can imagine the figurines of Santa Clause, reindeer, and sleigh high in a tree with figurines of toy soldiers, candy canes, and the like on the ground. From the manufacturer's view point, it is desirable to have a stream of sales continuing from year to year, perhaps Santa Clause this year, reindeer next year, for Christmas, or jack-o-lanterns this year, ghosts next year, and skeletons the following year, for Halloween. Hence, the manufacturer wants a flexible system which may be expanded with new features as time goes by. Still another consideration is the safety features provided by outdoor lighting which may be exposed to almost any kind of weather ranging from ice and snow through drenching rain to summer heat. The various electrical fittings, couplers for mounting the light, and the like should be resistant to these and other weather related problems. These features should be available with a great variety of light bulbs, and both low voltage and commercial voltages.

SUMMARY

Accordingly, an object of the invention is to provide new and improved home decorative lighting systems. In particular, an object is to provide flexibility of lighting which enables the user to exercise creativity in displaying the decorative lighting.

In keeping with an aspect of the invention, these and other objects are provided by a number of seasonal figurine characters such as jack-o-lanterns, Santa Clause, etc. While these figurine characters may be made by any suitable means, blow molded plastic is one way that produces good results. The plastic, or other materials, should be able to transmit light from a light bulb inside the figurine to be seen from outside the figurine. The light bulbs may be connected to these seasonal figurine characters on either their top or their bottom, or both. The seasonal characters which have top mounted bulbs contain a hole through which a light bulb may be inserted in the figurine. An elastomeric ring coupler fits snugly around the base of a light bulb and then snaps into the circular hole. For this type of mount, the preferred electrical circuit is a string of in-door/out-door lights, such as the familiar Christmas tree lights. For the bottom mounted bulbs, the figurines have an adapter mounting plate, some plates with a plurality of couplers which fit on a great variety of existing outdoor ground lighting fixtures, other mounting plates being specifically designed to fit on separately provided support stakes.

Preferred embodiments of the invention are shown in the attached drawings, in which:

DETAILED DESCRIPTIONS

Figure 1:
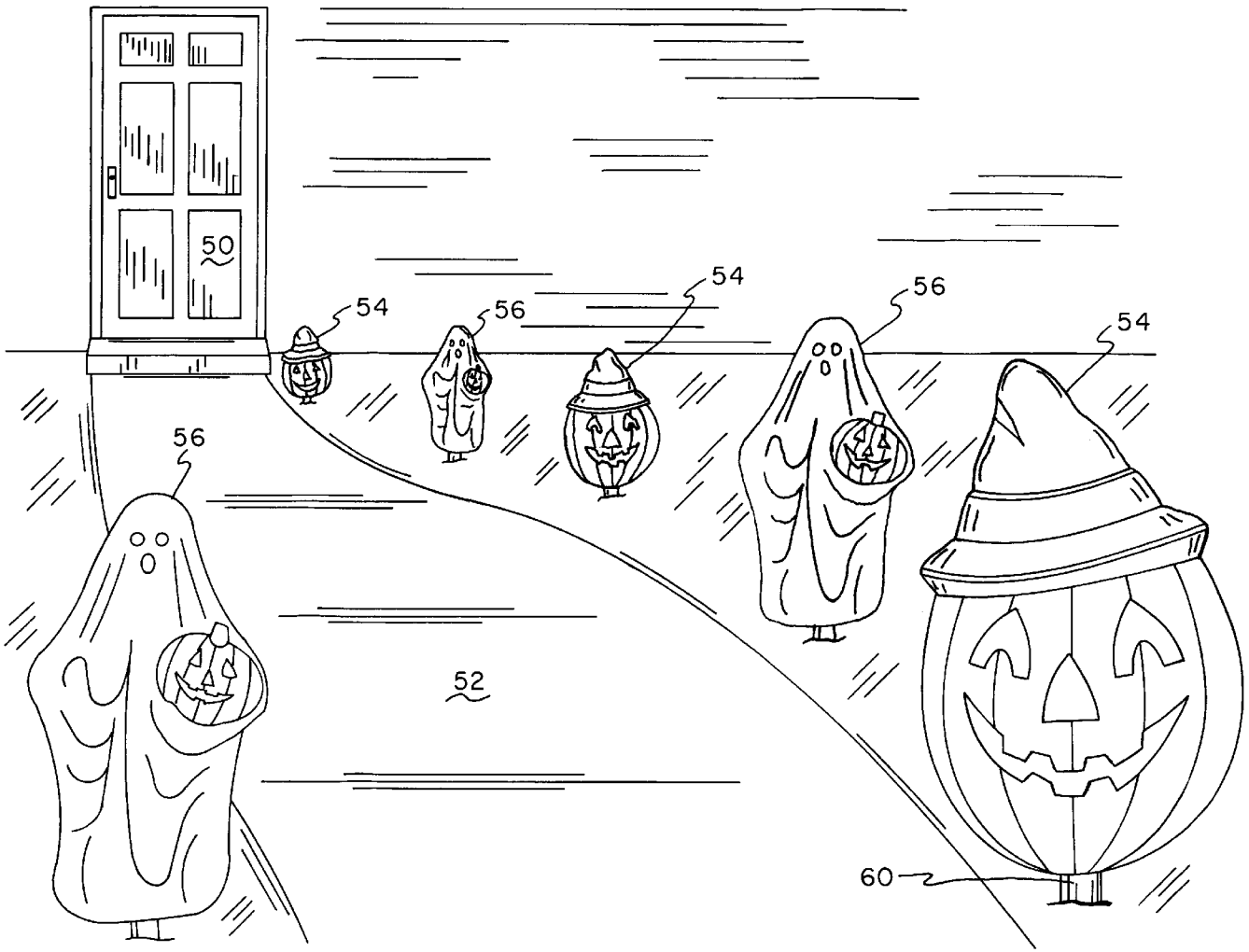
FIG. 1 is an artist's rendering showing a front of a house decorated at ground level by a family of lighted figurines appropriate for halloween.
Figure 2:
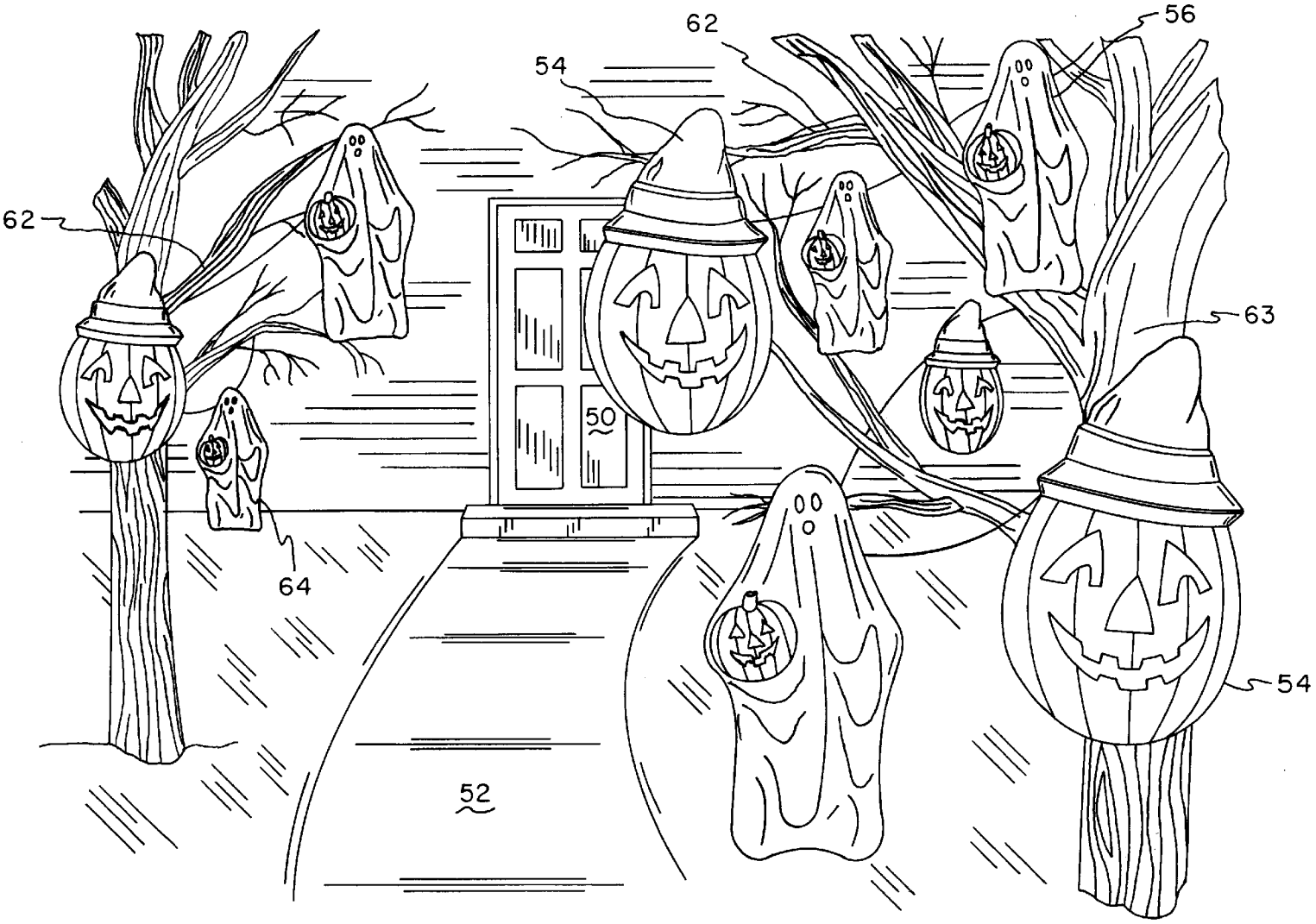
FIG. 2 is an artist's rendering showing the same house decorated by substantially the same family of figurines, but primarily at tree level.

FIGS. 1 and 2 show essentially the same family of figurines which are suitable for halloween. Of course, this particular family may be expanded to cover other appropriate halloween figurines, such as witches, black cats, skeletons, and the like. The manufacturer may introduce these and other figurines on successive years in order to promote a continuing stream of sales.

In greater detail FIG. 1 shows a front door 50 of a house with a sidewalk 52 leading thereto. Along the walk way are a family of ground mounted figurines, here shown as jack-o-lanterns 54 and ghosts 56, in a line on opposite sides of the sidewalk. The figurine 58 indicates that they may be positioned on both sides of the sidewalk, if desired.

Each figurine is mounted on top of a post or stake 60 that is mounted or driven into the ground. These posts or stakes may be parts of the permanently installed low-voltage ground lighting system which already exists in front of many houses. If so, the existing lighting fixtures are removed and the inventive figurines substituted therefor. In the alternative, the posts or stakes 60 may be special stakes which are specifically made for and seasonally installed to support the figurines.

FIG. 2 shows the same family of figurines 54, 56, but these are adapted to be hung from limbs 62 of trees 63, for example. The figurine 64 indicates that the tree mounted figurines 54, 56 may be mixed with ground mounted figurines 64.

Figure 3:
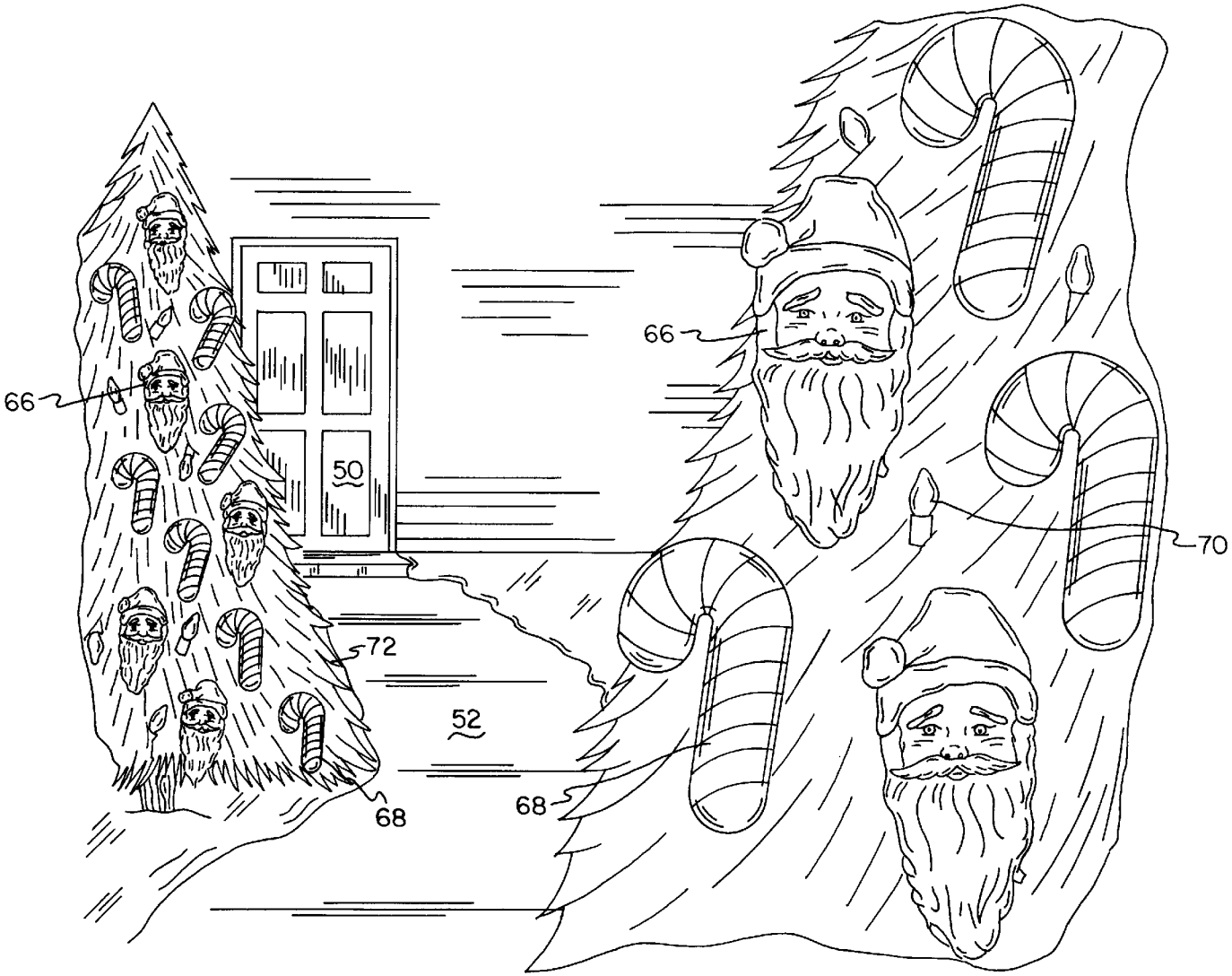
FIG. 3 is an artist's rendering showing the same house decorated by a different family of lighted figurines appropriate for Christmas.

FIG. 3 is a showing of a family of figurines appropriate for Christmas, which illustrates that any appropriate season may be accommodated. For example, the family of figurines may include bunnies and eggs for Easter, or uncle Sam and an eagle for the 4th of July. Also, FIG. 3 shows a Santa Claus 66 and a candy cane 68 as exemplary of a Christmas time family of figurines used in a different way, since conventional Christmas tree lights 70 may be mixed in with the figurines and since the figurines are used in a more or less conventional way to decorate a Christmas tree 72.

Figure 4:
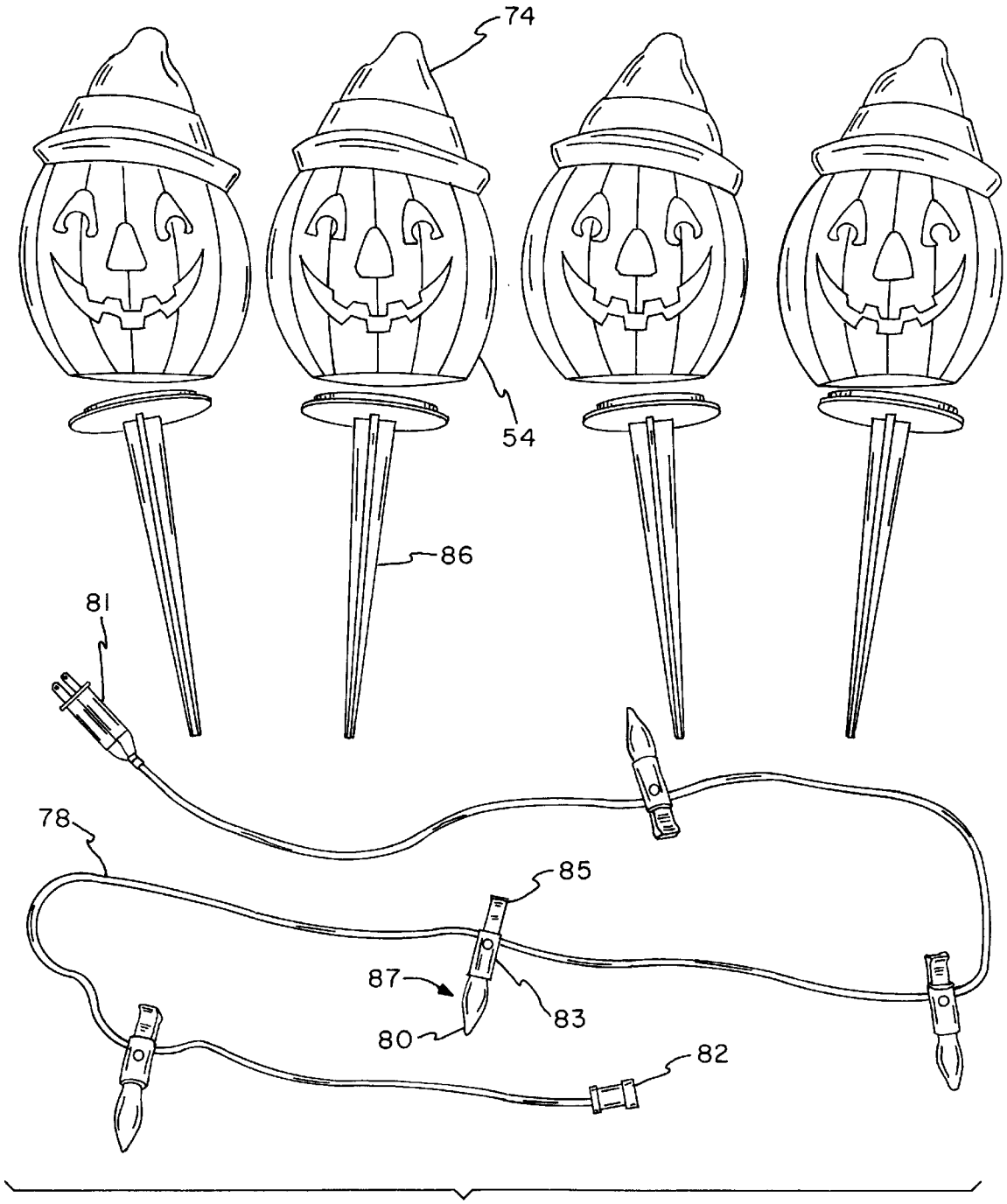
FIG. 4 is a kit of figurines with adapters which may be used either to hang lighted figurines from a tree, or the like, or to mount them on the ground.

FIG. 4 shows the invention in a form of an exemplary kit which might be purchased as a unit. Any suitable figurine may be sold in a kit, here shown as an exemplary jack-o-lantern 54. An indoor/outdoor string 78 of Christmas tree lights has a number of light bulbs 80 distributed along the length thereof. On one end, a plug 81 may be connected into any wall outlet (not shown) or the like. A socket 82 terminates the other end of the string of lights 78 so that a plurality of strings of lights may be joined together. Each light bulb 80 is mounted in a base socket 83 which may have a clip 85 associated therewith in order to anchor it to any suitable support such as a tree limb, for example.

Each figurine also has an associated stake 86 which may be pressed into the earth. A pair of suitable connectors on top of the stake and on the bottom of the figurine may be used to join the figurine and stake as a rigid unit. In this example, the stakes are pressed into the earth at intervals corresponding to the spacing between the lights 87 along the length of wires 78.

Figure 5:
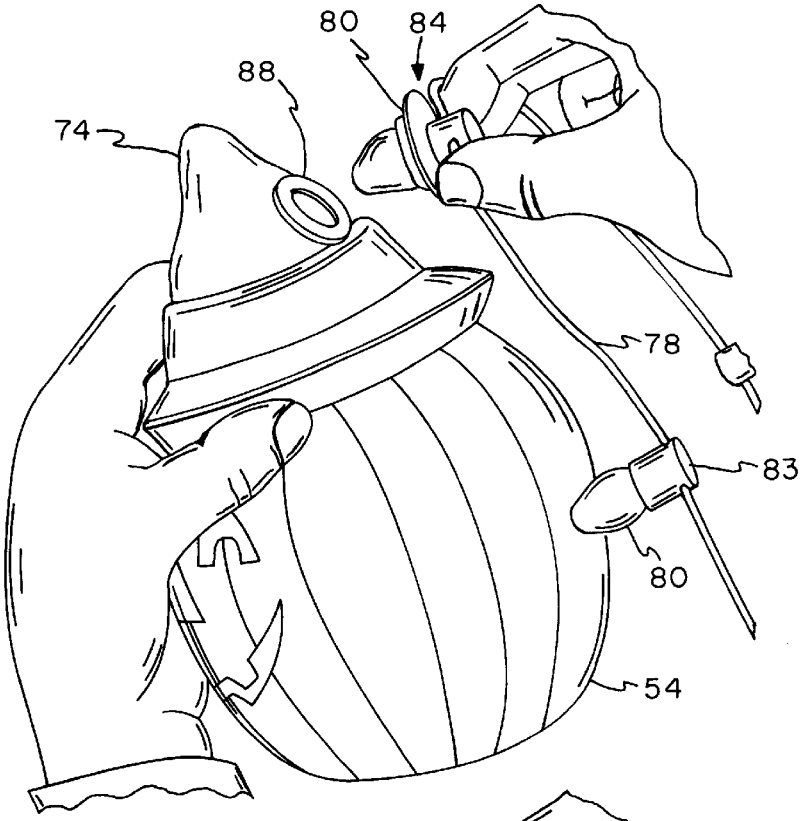
FIGS. 5 and 6 are perspective views of a figurine having top mounts by which the figurines may be mounted in a tree.

FIG. 5 illustrates a preferred construction of a figurine, here a jack-o-lantern 54, which may be hung from above. At the top 74, the figurine preferably terminates in a sloping roof which tends to shed precipitation in the form of rain, water, snow and the like and which resists a build-up of ice.

On the slope of the roof, a hole 88 is formed in the figurine. An elastomeric connector substantially fills the space between the light bulb and the hole to help resist entry of water into the interior of the figurine. Light bulbs on the string 78 of indoor/outdoor Christmas tree lights is used to light the interiors of the figurines.

FIG. 5 has been drawn to show one light bulb 80 and base socket 83 being inserted into the elastomeric connector in hole 88. If desired a mating connector may surround the base 83 in order to cooperate with the elastomeric connector and to help make the weather resistant seal.

Figure 6:
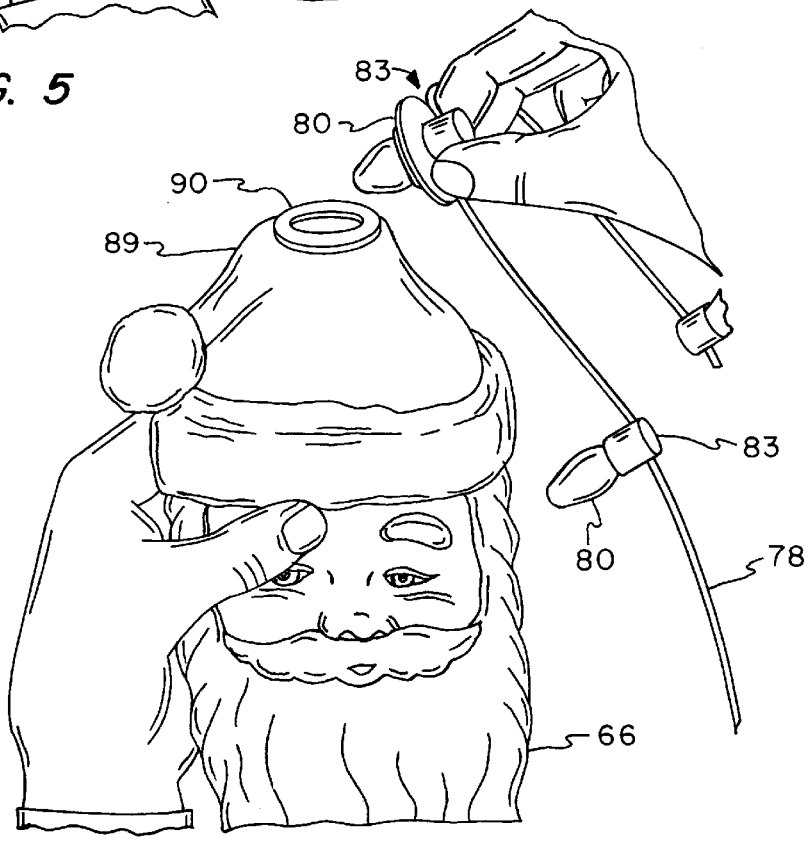
Figure 7:
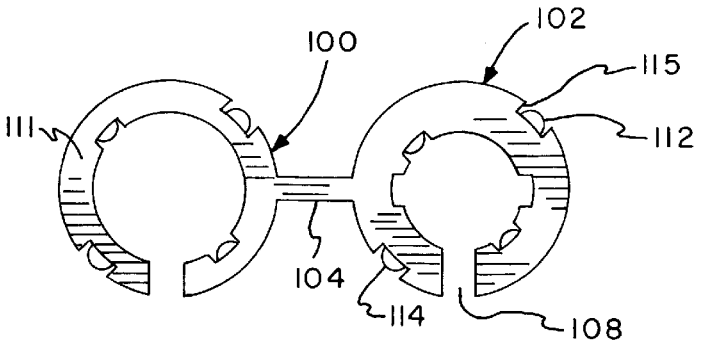
FIGS. 7, 8, and 9 are top plan, side elevation, and bottom plan views, respectively, of an elastomer coupler for mounting a light bulb in a figurine.
Figure 8:
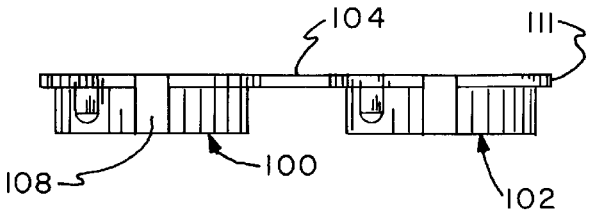
Figure 9:
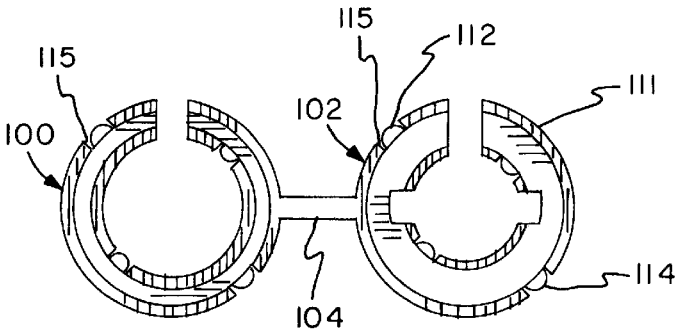

FIG. 6 shows an alternative embodiment which still has a sloping roof 89 to shed precipitation in the form of rain and snow. Here, however, the hole and elastomeric coupler 90 is on a point at the top of the roof. The elastomeric coupler substantially seals the opening. Again an indoor/outdoor string 78 of Christmas tree lights is used to light the interior of the figurine.

Figure 13A:
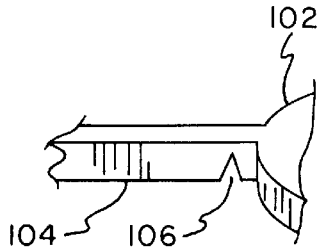
FIGS. 13A and 13B are fragments of FIGS. 7–9 which show that the elastomer adapters may be snapped or cut apart.
Figure 13B:
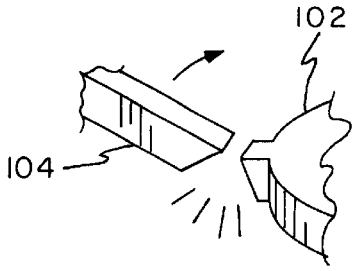

The preferred elastomeric connector is seen in FIGS. 7–10. For economy of production a mold may be constructed to make any suitable number of connectors at a single molding. As here shown, two connectors 100, 102, joined by a common gate 104, are made as a unit. As shown in FIGS. 13A and 13B, these connectors 100, 102 are broken or cut apart so that they may be used as individual units. To facilitate such separation, the gate 104 is molded with a weakened section 106.

Figure 10:
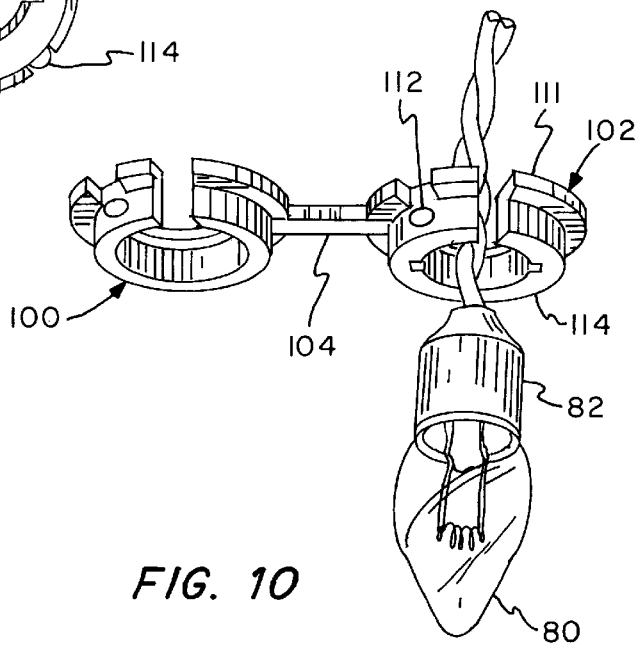
FIG. 10 is a perspective view of a light bulb in an elastomeric coupler of FIGS. 7–9.

Each connector 100, 102 is molded in the form of a split ring which easily receives and embraces the base socket 83 (FIG. 10). In the example of FIG. 5 where the connector is on the slope of the roof 74, the gap 108 is preferably placed in the lower most position along the slope formed by the hat on the jack-o-lantern.

Figure 12:
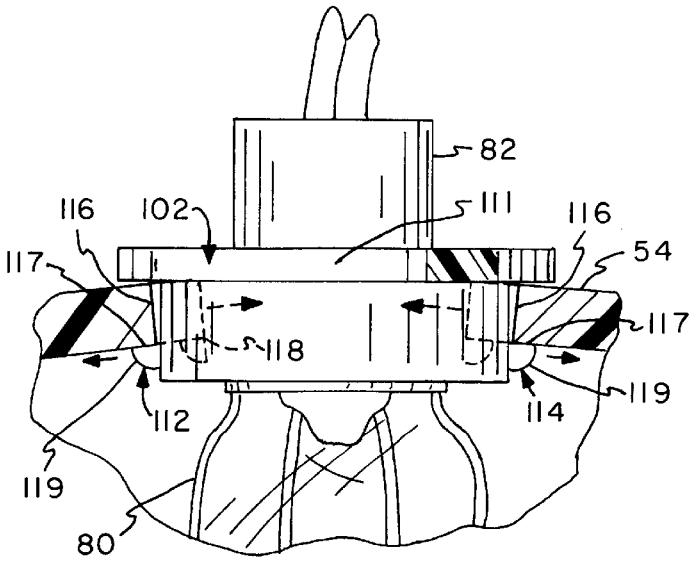
FIG. 12 is a side elevation, partially in cross section, showing the bulb and elastomeric connector in place in a figurine.

Each elastomeric connector 100, 102 has a flange 111 on its upper surface. Two diametrically opposed lugs 112, 114 are displaced (FIG. 12) from flange 111 to define a connection region formed on the outer circumferential periphery of the connectors. The openings 115 (FIG. 7) in flange 111 are where a mold part fits in order to form a ledge 117 on top of the lugs 112, 114. As best seen in FIG. 12, each of these lugs includes a cam surface 119 on its lower surface.

By simply pushing the cam surfaces 119 into the hole 116, the lugs 112, 114 are guided and directed to move inwardly until the lugs pass through the hole and into engagement with the underside of the figurine plastic wall. More particularly, as it passes through hole 116, the inward motion of the elastomeric connector 102 is shown in FIG. 12 by dashed lines 118. Then, the resilience and memory of the elastomeric material causes the split ring connector 102 to return toward its original size causing the lugs 112, 114 to pop out under the edge of the hole in the plastic wall 116 of the figurine. Thus, the ledge 117 engages the under side and flange 111 engages the outer side of the figurine in order for the plastic wall surrounding hole 116 to capture and lock the elastomeric connector 102 in place within the hole 116.

Figure 11:
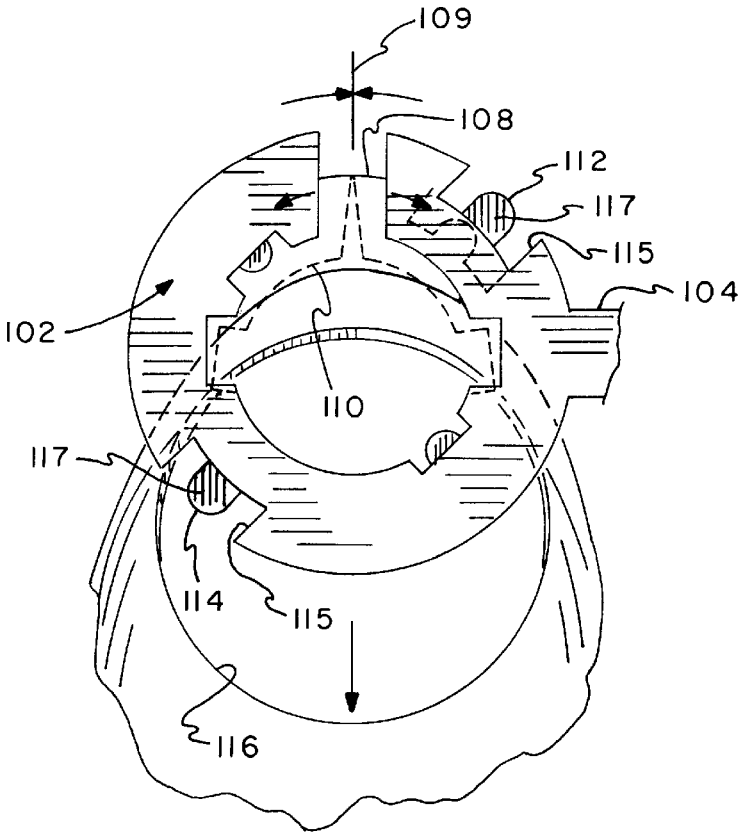
FIG. 11 is a perspective view of an elastomeric coupler being installed in a figurine.

If it should be necessary to remove the connector 102, as to replace a burned out bulb, for example, the split ring is squeezed to close gap 108, again as shown by dashed lines 110 in FIG. 11. After the diameter of the connector 102 is reduced, it may be removed from hole 116.

Figure 14B:
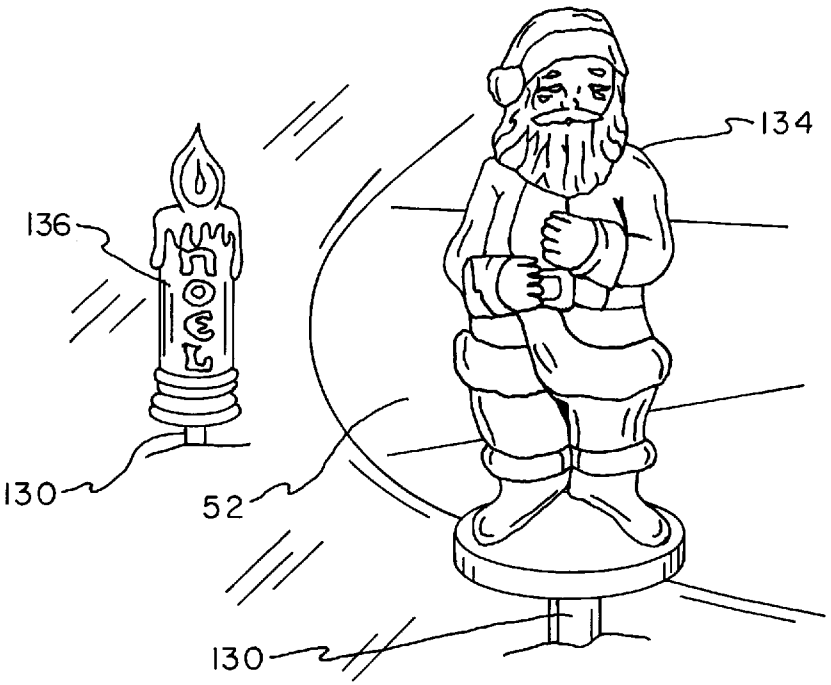
FIGS. 14A and 14B are artist's renditions showings of how the inventive figurines may be used in connection with an existing ground lighting system.
Figure 14A:
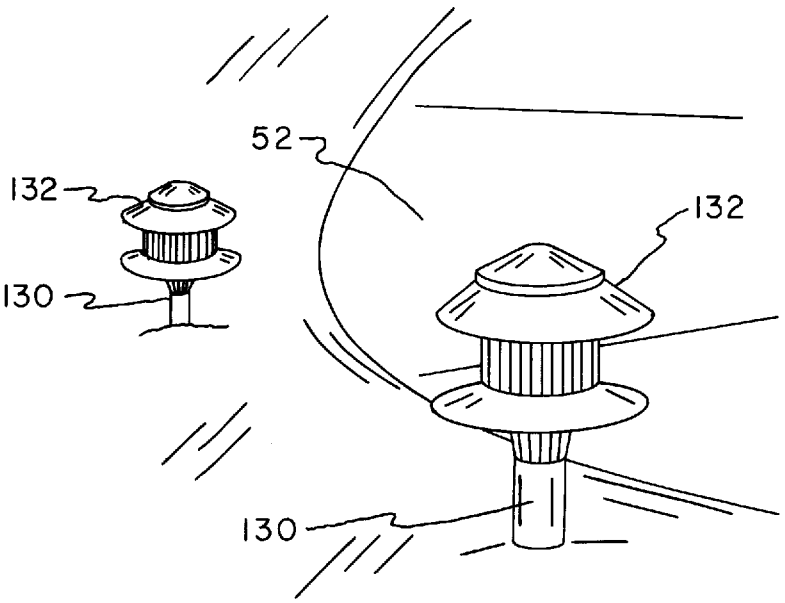
Figure 15:
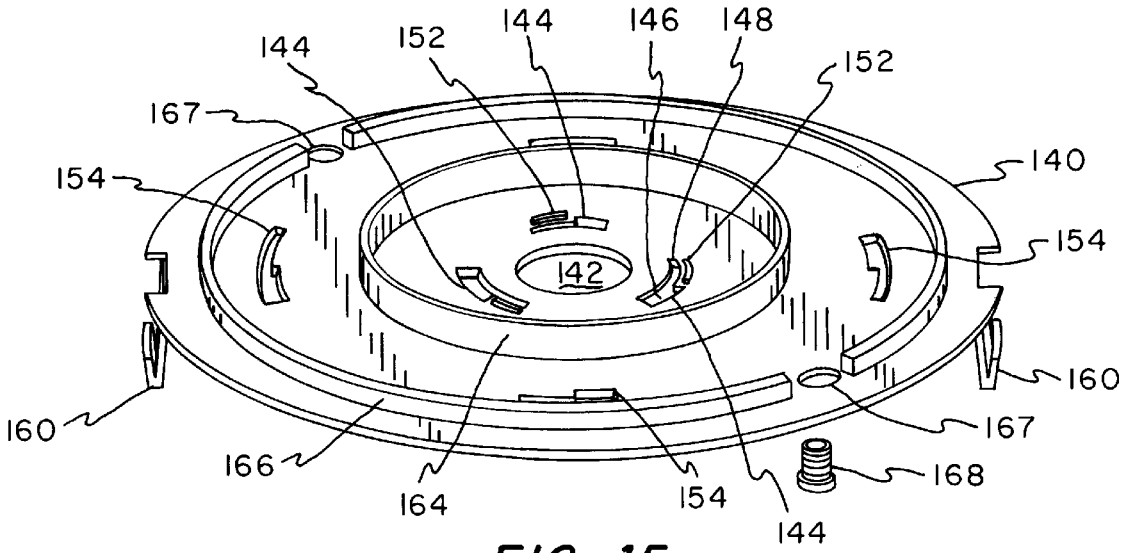
FIG. 15 is a perspective view featuring the top surface of an adapter mounting plate.
Figure 17:
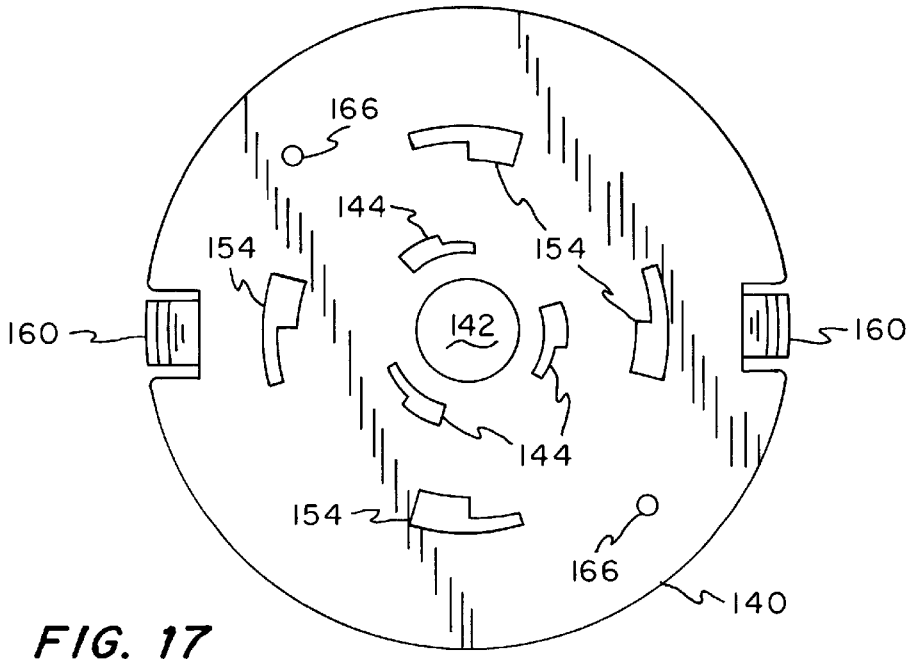
FIG. 17 is a plan view of the bottom of a mounting plate for a ground mounted figurine.
Figure 16:
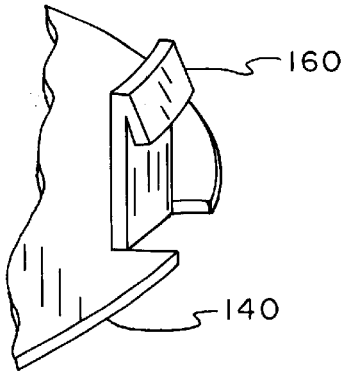
FIG. 16 is a perspective view of a fragment of FIG. 15, showing a connector on the mounting plate.
Figure 18:
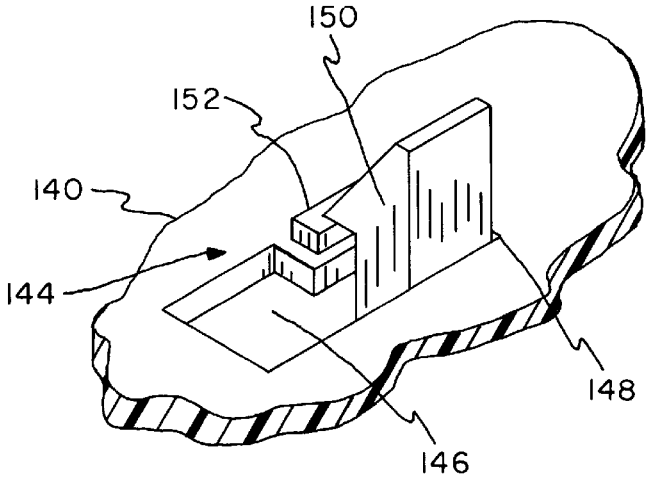
FIG. 18 shows a fragment of the mounting plate being held in place by a latch on a mounting stake.

FIGS. 14A, 14B illustrate how the invention may be used in connection with existing ground lighting systems. In FIG. 14A, an exemplary ground lighting system is shown as commonly used year around. A number of posts 130 are permanently implanted in the earth adjacent sidewalk 52. Each post 130 has a suitable weather proof fixture 132 mounted thereon. To wash a globe in the fixture or to a replace burned out light bulb, for example, the fixture 132 may be removed from and replaced upon the post 130.

At a season when the inventive decorative system is used (FIG. 14B), the fixtures 132 are removed and the figurines are placed on the posts 130 (FIG. 14B). In this example, a Santa Clause 134 and Christmas candles 136 have replaced the conventional fixtures 132 normally supported on the posts 130.

There are a number of different connectors which may be used to mount either the conventional fixtures 132 or the decorative figurines 134, 136 on the posts 130 in ground lighting systems. For example, well known ground lighting systems are sold under the individual trademarks "Malibu", "Toro", and perhaps other marks. Each of these ground lighting systems has its own particular way of connecting the fixture to the posts or stake.

FIGS. 15–18 show an adapter mounting plate 140 which may be used with the figurines in order to match them to any of the particular posts that may be part of the popular ground lighting systems installed around the user's house. This mounting plate has three separate types of connectors arranged in concentric circles. In the center of the mounting plate 140, a hole 142 is formed to receive a light bulb.

Figure 19:
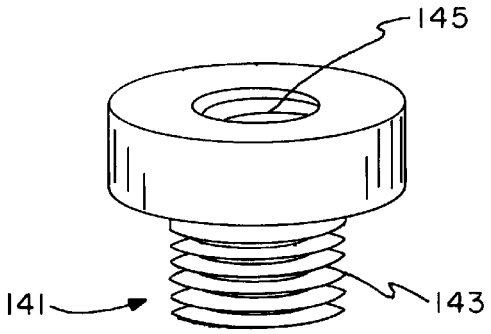
FIG. 19 is a perspective view which shows an adapter for reducing a common 110 V. light bulb base to a socket size which receives a Christmas tree light bulb.

If a Christmas tree string of lights are used, they may be used with the elastomeric connector 102, as shown in FIGS. 10–12. If a conventional 110 V. commercial power light bulb is used, the hole 142 may be large enough for the bulb to pass through. In some cases, a special adapter 141 (FIG. 19) having a 110 V. lamp base 145 with a unitarily attached Christmas tree bulb socket 143 may be screwed into a lamp socket in the permanent stake 130 so that the interior of the figurines is lit by a Christmas tree size bulb. Normally, the smaller wattage bulbs are preferred for decorative lighting.

On the mounting plate 140 (FIGS. 15–17), a first and smallest of the concentric circles of connectors has three openings 144 which receive upstanding latches on a post of a commercial ground lighting system. More particularly, each opening 144 has a relatively large area 146 (FIG. 18) and a relatively small area 148. An upstanding latch 150 may pass through the large open area 146. Then, the mounting plate 140 is turned so that the small open area passes under the latch 150, thereby clamping the mounting plate to the post. A stiffening rib 152 is integrally molded on plate 140 and positioned adjacent the small area 148 in order to receive and support the latch 150, thereby proving a greater strength at the anchor point.

Another commercial ground lighting system has a similar latch, except that there are four latches arranged to couple into a middle one of the concentric circles of connectors formed on mounting plate 140. The adapter mounting plate 140 has four openings 154 which are constructed substantially the same as the openings 144 shown in FIG. 18. However, this system has larger latches which engage a larger surface area on the plate 140. Also a fence 166 is molded on plate 140 near the openings 154, all of which give a greater mechanical strength to the coupler system. Therefore, the stiffening ribs 152 are not normally required at openings 154.

A third type of commercial ground lighting system has posts 130 (FIG. 14A) with openings somewhat similar to openings 144 and 154. Therefore, the inventive mounting plate 140 has two diametrically disposed latches 160 dependant from its bottom surface and located in the largest diameter mounting circle on plate 140. These latches snap into and latch over openings in the post 130.

Centrally located on plate 140 is a relatively high circular fence 164 concentric with the relatively low circular fence 166. The bottom of the figurine has a relatively large hole which fits over the high fence 164 in order to locate and fix the position of the figurine on the mounting plate. For a relative low cost construction, molded plastic tends to have high spots and low spots. Any attempt to secure two flat plastic plates in face-to-face contact often results in contact at only a few points with gaps at other points. Therefore, a figurine with a flat bottom might wobble if it is connected directly to a two flat plastic plate in a face to face contact. To avoid such a wobble, the invention uses the relatively low circular fence 166 for the figurine to abut against and support itself on its solid bottom surface, which prevents a wobble.

Two diametrically opposed mounting holes 167 are formed in the mounting plate 140 to receive screws 168 which fasten the mounting plate to the bottom of the figurine. Preferably, the screws 168 are self tapping screws which are turned into holes in the plastic wall. The mounting holes 167 are in the circle formed by the low fence 166 so that the screws are pulling the plastic of the figurine into direct contact with the low circular fence 166.

Figure 20:
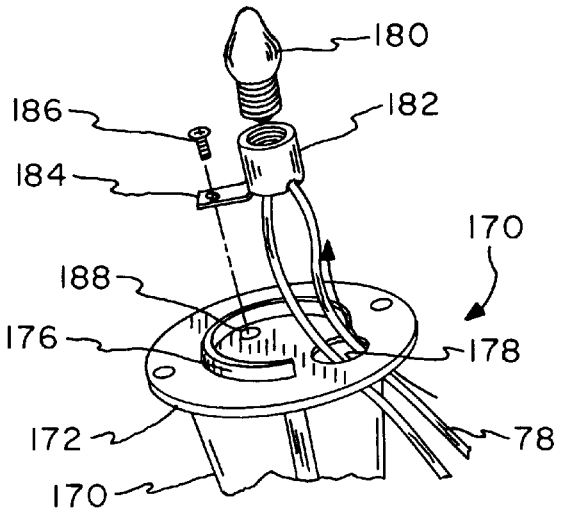
FIG. 20 is a perspective view of a mounting plate which is especially for use with the inventive figurines.
Figure 21:
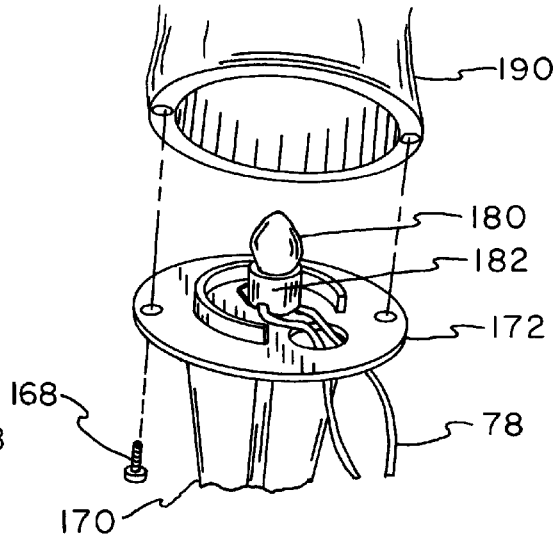
FIG. 21 is a perspective view of a figurine being mounted on the mounting plate of FIG. 20.
Figure 22:
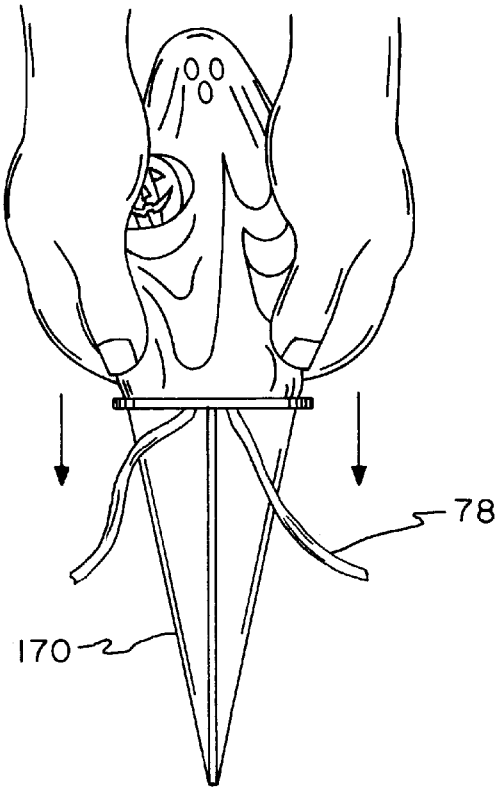
FIG. 22 shows the combined figurine and mounting plate being driven into the ground.

FIGS. 20–22 show an alternative and simplified adapter mounting plate for the kit shown in FIG. 4. In this particular example, the prior connectors used with conventional ground lighting system is not important. However, the principles shown herein may be combined with the principles shown in FIGS. 15–18. For example, the manner of mounting a Christmas tree light bulb that is used in FIG. 12 may also be used in FIG. 20. Likewise, any one or more of the types of connectors shown in FIG. 15 may be added to the mounting plate of FIG. 20.

In greater detail, FIG. 20 shows a plastic stake 170 having a mounting plate 172 integrally formed thereon. For added strength, the cross section of the stake 170 has an "X" shape. The mounting plate 172 has an upstanding circular fence 176 which is similar to circular fence 164 (FIG. 15) and is used to center the figurine standing thereon. The mounting plate 172 has a hole 178 which is large enough for a light bulb 180 and base 182 to pass through. The base 182 has an associated anchoring bracket 184. A screw 186 passes through a hole in bracket 184 and turns into a hole 188 in the mounting plate 172. Preferably the screw 186 is self-tapping.

Once the light bulb base 182 is anchored on mounting plate 172, a figurine 190 is attached to the mounting plate 172 (FIG. 21) by screws 168. Once the figurine 190 and the stake 174 are joined, they are pressed into the earth (FIG. 22).

Those who are skilled in the art will readily perceive how to modify the invention. Therefore, the appended claims are to be construed to cover all equivalent structures which fall within the true scope and spirit of the invention.

The claimed invention is:

1. A decorative lighting system comprising a plurality of figurines, at least one hole formed in each figurine for receiving a light bulb for lighting an interior of said figurine, means for interconnecting said light bulbs to enable said plurality of figurines to be arranged in a selected spatial combination, and means for both suspending said figurines from above and mounting them from below, wherein at least one of said figurines has a sloping top surface to provide a roof for shedding precipitation, said hole is formed on said sloping surface, and an elastomeric connector secures said light bulb in said hole, said elastomeric connector comprises a split collar having an upper flange and lugs on a lower surface thereof, a cam surface on the bottom of said lugs to guide them to pass through said hole and capture a wall surrounding said hole, said capture being between said flange and said lugs.

2. A home decoration system comprising a plurality of hollow figurines, each figurine having a top, a hole formed in the top of each figurine for receiving a light bulb mounted in a base, a wall of said figurine surrounding said hole, means for interconnecting a plurality of said light bulb bases in the form of an indoor/outdoor Christmas tree string of lights, an elastomeric coupler surrounding said base and anchoring said bulb in said hole formed in said figurine, said coupler comprising a split elastomeric ring having a flange on its upper surface and lugs on its lower surface, said flange being spaced from said lugs by a distance substantially equal to a thickness of the wall of said figurine which surrounds said hole.

3. The system of claim 2 and means associated with each of said bases in order to suspend said figurines from overhead structures.

4. The system of claim 2 and a stake for mounting each of said figurines on the ground, a top of said stake having a mounting plate with a hole therein for receiving a light bulb, said mounting plate being attached to a bottom surface of said figurine.

5. The system of claim 2 wherein each of said figurines has a pointed upper surface forming a weather resistant roof, and said split ring of said elastomeric coupler is fitted into said hole.

6. A decorating system for use with a permanently installed ground lighting system, there being a plurality of different types of such ground lighting systems, said ground lighting system comprising one or more permanently installed posts for supporting individually associated lighting fixtures, a coupler on said post for removably mounting said fixture on said post, each of said types of said ground lighting systems having its own type of couplers whereby said plurality of ground lighting systems have a number of different kinds of ground lighting system couplers, said decorating system comprising: an adapter mounting plate having a plurality of different couplers formed thereon, there being a coupler for each of said types of ground lighting system couplers whereby said adapter mounting plate can be used with any one of said different types of ground lighting systems, an upstanding fence on said adapter mounting plate, a plastic figurine having a hole formed in the bottom thereof, said hole being shaped and sized to receive said upstanding fence, means for attaching said adapter mounting plate to said figurine, means for supporting a light bulb inside figurine, said light bulb being coupled to receive power from a source used by said ground lighting system for powering a light bulb inside said fixture, and an elastomeric coupler surrounding said light bulb inside said figurine and making a physical connection between said adapter mounting plate and said light bulb.

7. The decorating system of claim 6 wherein said ground lighting system couplers comprise latches located in circular array, each of said kinds of ground lighting systems having its latches located in a circle having a diameter which is different from diameters of other of said kinds of ground lighting system, and said adaptor mounting plates has mating couplers arranged in concentric circles with diameters of said concentric circles corresponding to and enabling said adapter mounting plate to receive the latches of each of said different kinds of ground lighting systems.

8. The decorating system of claim 7 wherein some of said mating couplers comprise a large opening communicating with a small opening, said large opening having a shape and size for receiving said latch, and said small opening capturing said latch in response to a rotational movement of said adapter mounting plate.

9. The decorating lighting system 7 wherein at least some of latches are located on and dependant from said adapter mounting plate, and said post has mating couplers for receiving said dependent latches.

* * * * *